US007905209B2

(12) United States Patent
Goto et al.

(10) Patent No.: US 7,905,209 B2
(45) Date of Patent: Mar. 15, 2011

(54) GLOW PLUG WITH COMBUSTION PRESSURE SENSOR

(75) Inventors: Tsunetoshi Goto, Handa (JP); Takehiro Watarai, Kuwana (JP); Yoshinobu Hirose, Mie-ken (JP)

(73) Assignee: Denso Corporation, Kariya (JP)

( * ) Notice: Subject to any disclaimer, the term of this patent is extended or adjusted under 35 U.S.C. 154(b) by 282 days.

(21) Appl. No.: 12/198,412

(22) Filed: Aug. 26, 2008

(65) Prior Publication Data

US 2009/0056660 A1 Mar. 5, 2009

(30) Foreign Application Priority Data

Aug. 30, 2007 (JP) ..... 2007-224595

(51) Int. Cl.
*F02P 23/00* (2006.01)

(52) U.S. Cl. ..... 123/143 R; 123/145 A

(58) Field of Classification Search ..... 123/143 R, 123/145 A; 219/260–270
See application file for complete search history.

(56) References Cited

U.S. PATENT DOCUMENTS

| | | | | |
|---|---|---|---|---|
| 7,313,949 | B2 * | 1/2008 | Yorita et al. | 73/114.07 |
| 7,337,657 | B2 | 3/2008 | Haussner et al. | |
| 2004/0261502 | A1 * | 12/2004 | Watarai et al. | 73/35.13 |
| 2006/0218997 | A1 * | 10/2006 | Yamada et al. | 73/115 |
| 2007/0163329 | A1 * | 7/2007 | Last et al. | 73/35.12 |
| 2007/0227487 | A1 * | 10/2007 | Last et al. | 123/145 A |
| 2007/0289370 | A1 * | 12/2007 | Hirose et al. | 73/116 |
| 2007/0295710 | A1 * | 12/2007 | Yamada et al. | 219/270 |
| 2010/0050991 | A1 * | 3/2010 | Cooke | 123/470 |

FOREIGN PATENT DOCUMENTS

| | | |
|---|---|---|
| JP | 59-085932 | 5/1984 |
| JP | 2004-124910 | 4/2004 |
| JP | 2004-124911 | 4/2004 |
| JP | 2005-090954 | 4/2005 |
| JP | 2006-266526 | 10/2006 |

OTHER PUBLICATIONS

Japanese Office Action dated June 9, 2009, issued in corresponding Japanese Application No. 2007-224595, with English translation.

* cited by examiner

*Primary Examiner* — John T Kwon
(74) *Attorney, Agent, or Firm* — Nixon & Vanderhye PC

(57) ABSTRACT

A glow plug with combustion pressure sensor is disclosed having a cover and a housing with which a piezoelectric element is hermetically accommodated. A lead wire having flexibility is employed to supply electric power to a heating member. The lead wire, fixedly connected to the heating member, extends through an insertion bore of the cover and is hermetically bonded to an inner circumferential wall of the insertion bore. When the heating member is axially displaced upon receipt of a combustion pressure, the lead wire flexes to absorb the resulting displacement, causing a joint portion between the cover and the lead wire to have no drag against the displacement. This allows the piezoelectric element to detect the combustion pressure with high precision.

9 Claims, 3 Drawing Sheets

GLOW PLUG WITH COMBUSTION PRESSURE SENSOR

CROSS REFERENCE TO RELATED APPLICATIONS

This application is related to Japanese Patent Application No. 2007-224595, filed on Aug. 30, 2007, the content of which is hereby incorporated by reference.

BACKGROUND OF THE INVENTION

1. Technical Field of the Invention

The present invention relates to combustion pressure sensors for use in internal combustion engines and, more particularly, to a glow plug with combustion pressure sensor for detecting a pressure in a combustion chamber formed in an engine head to allow an engine to be controlled based on a detected pressure to achieve an optimized combustion state.

2. Description of the Related Art

There has heretofore been generally known a glow plug with combustion pressure sensor composed of a glow plug, preheating a combustion chamber when starting up an engine, and a combustion chamber which are integrally structured for detecting a pressure inside the combustion chamber. Japanese Patent Application Publication No. 2005-90954 discloses one example of such a structure, which is shown in FIG. 3. FIG. 3 is a typical view showing a glow plug with combustion pressure sensor 300 of the related art that is mounted on an engine head 301.

Hereunder, for the sake of convenience of illustration, an upper area and a lower area in FIG. 3 are referred to as a base end or base end portion and leading end or leading end portion, respectively.

The glow plug with combustion pressure sensor 300 has a heating rod 31, having a leading end exposed to a combustion chamber 302, which has a base end portion connected to an intermediate shaft 37 made of metal to act as an electrode. The intermediate shaft 37 and a heating member are electrically connected to each other. The intermediate shaft 37 protrudes from a housing 30 and fixedly retained with a contact tube 34 via an O-ring 38.

With such a structure, the heating rod 31 is displaced toward the base end of the glow plug with combustion pressure sensor 300 in response to fluctuation in combustion pressure inside the combustion chamber 302. This causes the contact tube 34, fixed to the heating rod 31, to be displaced toward the base end. With such displacement, a diaphragm 35, fixed to the engine head 301 via the housing 30, has one portion, fixedly secured to a base end of the contact tube 34, which is displaced toward the base end relative to another portion fixed to the housing 30. This causes strain to occur on the diaphragm 35. A combustion pressure sensor 36, placed on the diaphragm 35 at a base end thereof, detects a pressure inside the combustion chamber 302 based on such strain.

With the structure of the related art shown in FIG. 3, the combustion pressure sensor 36 takes the form of a structure exposed to outside air. With such a structure, the combustion pressure sensor 36 directly receives an effect of outside air prevailing at a base end portion of the cylinder head 301. Thus, the combustion pressure sensor 36 detects the combustion chamber with degraded precision. In particular, with the combustion pressure sensor 36 arranged to detect the combustion pressure based on small changes in strain resulting from fluctuation in combustion pressure, a pyroelectric effect occurs due to moisture contained in outside air. This causes the combustion pressure sensor 36 to generate an output signal with variation caused by the pyroelectric effect, resulting in the detection of the combustion pressure with degraded precision.

With such a structure of the related art set forth above, an attempt may be made to provide a package member to cover the combustion pressure sensor 36. For the combustion pressure sensor 36 to be completely shut off from outside air, the package member and the intermediate shaft 37, made of metal, need to be hermetically sealed by welding. When this takes place, the package member and the intermediate shaft 37 are fixed to each other with accompanying difficulty of causing the heating rod 31 and the contact tube 34 to be displaced in an axial direction. Thus, the combustion pressure sensor 36 cannot take a structure needed for detecting the combustion pressure.

To address such an issue, the package member may be arranged to retain the intermediate shaft 37 via, for instance, an O-ring. Even under such an arrangement, a drag occurs on a contact portion between the package member and the O-ring due to sliding resistance occurring thereon during axial displacement of the intermediate shaft 37. This results in an effect of suppressing displacement of the heating rod 31, causing the combustion pressure sensor 36 to have difficulty in detecting the combustion pressure with high precision. In addition, the O-ring has an area, held in contact with the intermediate shaft 37, which is progressively worn away in operation of the combustion pressure sensor 36. Thus, the O-ring encounters a difficulty of ensuring a hermetic sealing effect, causing the combustion pressure sensor 36 to have a risk with the occurrence of pyroelectric effect.

SUMMARY OF THE INVENTION

The present invention has been completed with the above view in mind and has an object to provide a glow plug with combustion pressure sensor for detecting a pressure of a combustion chamber with high precision.

To achieve the above object, a first aspect of the present invention provides a glow plug with combustion pressure sensor comprising a heating member adapted to be placed in one end of a plughole to raise a temperature of a combustion chamber, a cylindrical member fixedly secured to an outer circumferential wall of the heating member, a housing adapted to be fixedly secured to the plughole and holding an outer circumferential wall of the cylindrical member for an axial displacement capability, a diaphragm fixedly supported with the housing and the cylindrical member, a combustion pressure sensor mounted on the diaphragm and responsive to strain occurring in the diaphragm due to axial displacement of the cylindrical member for detecting a combustion pressure of the combustion chamber, a cover associated with the housing to define a closed air space to hermetically accommodate the combustion pressure sensor and having an insertion bore, and a lead wire, having flexibility and fixedly connected to the heating member to supply electric power thereto, which extends through the insertion bore and is hermetically bonded to an inner circumferential wall of the insertion bore.

The present invention contemplates the provision of the glow plug with combustion pressure sensor having a structure including the lead wire provided in place of the metallic intermediate shaft employed in the structure of the related art. That is, the lead wire, having flexibility, serves as a member connected to the heating member for supplying electric power to the heating member. In addition, a hermetic sealing structure is provided to hermetically accommodate the combustion sensor.

With such a structure, the combustion sensor can be hermetically accommodated in a closed space between the housing and the cover. This prevents the occurrence of a pyroelectric effect on the combustion sensor, enabling the combustion sensor to detect the combustion pressure with high precision.

Even if the heating member is axially displaced in response to fluctuation in combustion chamber, further, the lead wire fixed to the heating member can be flexed due to own flexibility. This avoids a joint portion between the lead wire and the insertion bore of the cover from suffering the occurrence of a drag disturbing fine displacement of the heating element. Accordingly, the combustion sensor has no hindrance in detecting the combustion pressure with high precision.

With the glow plug with combustion pressure sensor of the present embodiment, the lead wire may preferably include a conductive wire and a shielding layer, made of insulating material and covered on an outer circumferential periphery of the conductive wire, which has flexibility.

With such a structure, the insulation of the lead wire can be ensured, enabling the combustion pressure sensor to detect the combustion pressure with high precision.

With the glow plug with combustion pressure sensor of the present embodiment, the combustion pressure sensor may preferably include one of a piezoelectric element and a strain gauge.

Such a structure allows the heating element to be axially displaced in response to fluctuation in combustion pressure, with accompanying capability of detecting strain of the diaphragm with high precision.

With the glow plug with combustion pressure sensor of the present embodiment, a clearance may be preferably provided between an outer circumferential wall of the lead wire and an inner circumferential wall of the cylindrical member.

The lead wire is liable to vibrate at its own natural frequency due to vibration exerted on the glow plug with combustion pressure sensor from an external source. If the lead wire is brought into contact with an inner periphery of the cylindrical member, the combustion chamber generates an output signal overlapped with noise in the presence of such a natural frequency, causing degradation in precision of detecting the combustion pressure. To address such an adverse affect, the clearance is provided between the outer circumferential wall of the lead wire and the inner circumferential wall of the cylindrical member to avoid the occurrence of abutting contact between the lead wire and the cylindrical member, resulting in an effect of suppressing the occurrence of noise.

With the glow plug with combustion pressure sensor of the present embodiment, the clearance may be preferably spaced in an extent not to cause the outer circumferential wall of the lead wire and the inner circumferential wall of the cylindrical member to be brought into contact with each other when the lead wire flexes greatest due to an axial displacement of the heating member caused by fluctuation in combustion pressure.

With such a structure, even if the heating member is axially displaced at a maximum extent to cause the lead wire to flex greatest, no risk occurs for the outer circumferential wall of the lead wire and the inner circumferential wall of the cylindrical member to be brought into contact with each other. This prevents the combustion pressure sensor from having degraded detecting precision resulting from the combustion pressure sensor generating the output signal overlapped with noise.

With the present embodiment, the glow plug with combustion pressure sensor may preferably further comprise an antivibration member disposed in the clearance between the outer circumferential wall of the lead wire and the inner circumferential wall of the cylindrical member.

As a result of repetition in natural oscillation of the lead wire due to vibration exerted on the glow plug with combustion pressure sensor, there is a risk of fatigue occurring in the lead wire in breakdown. Therefore, placing the antivibration member in the clearance between the outer circumferential wall of the lead wire and the inner circumferential wall of the cylindrical member enables the damping of natural oscillation of the lead wire. In addition, the antivibration member prevents the occurrence of a contact between the outer circumferential wall of the lead wire and the inner circumferential wall of the cylindrical member, thereby preventing noise from overlapping on the output signal of the combustion pressure sensor.

With the glow plug with combustion pressure sensor of the present embodiment, the antivibration member may be preferably made of resilient material. With the antivibration member made of resilient material, it becomes possible to prevent vibration of the antivibration member vibrating at a natural frequency from being transferred to the cylindrical member.

With the glow plug with combustion pressure sensor of the present embodiment, the heating member may preferably include a ceramic heater. Such a structure enables the provision of a glow plug with combustion pressure sensor having excellent durability in power supply with a capability of rapidly increasing a temperature of a combustion chamber.

DETAILED DESCRIPTION OF PREFERRED EMBODIMENTS

Now, glow plugs with combustion pressure sensors of various embodiments according to the present invention are described below in detail with reference to the accompanying drawings. However, the present invention is construed not to be limited to such embodiments described below and technical concepts of the present invention may be implemented in combination with other known technologies or other technology having functions equivalent to such known technologies.

Figure 1:
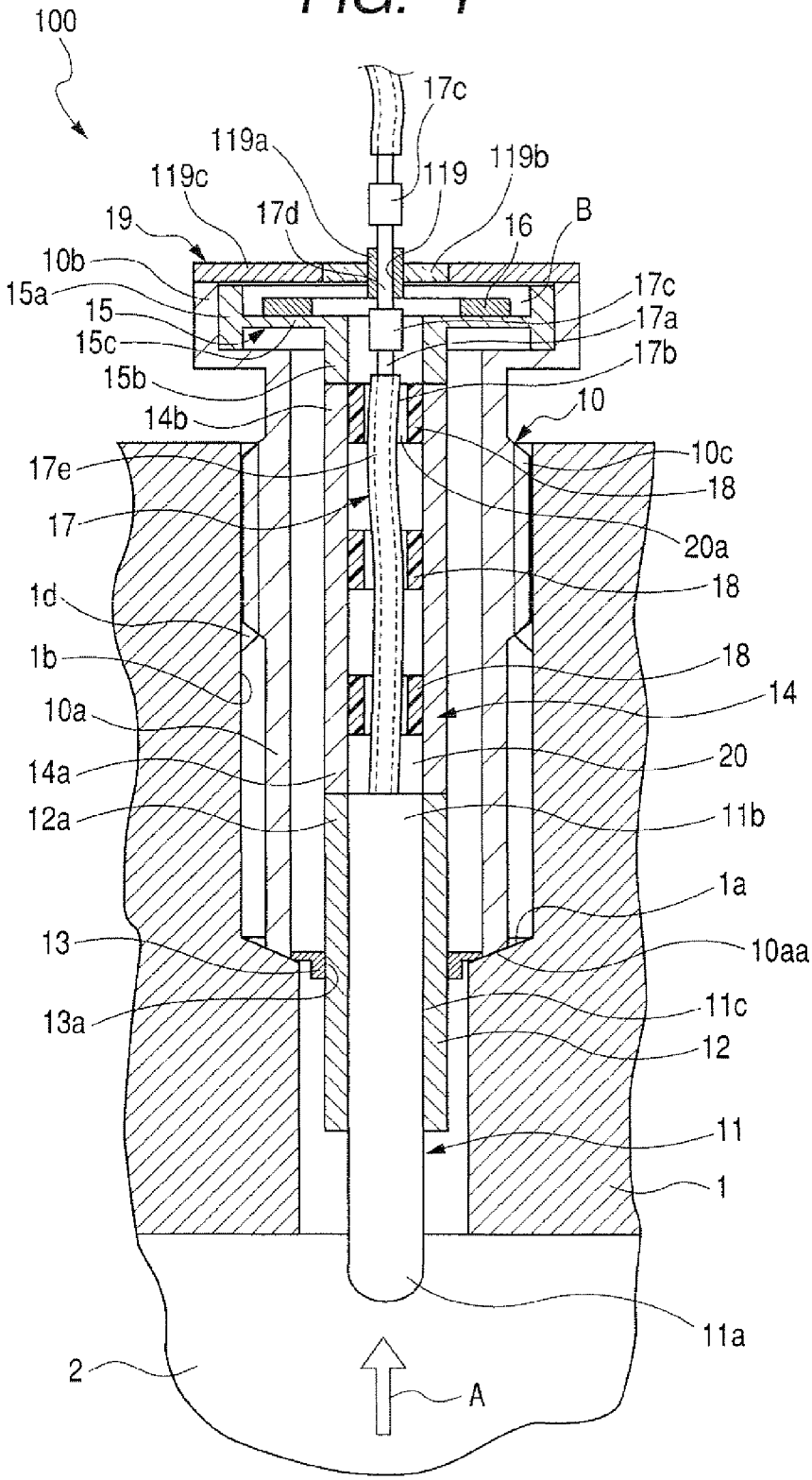
FIG. 1 is a longitudinal cross sectional view showing a glow plug with combustion pressure sensor of one embodiment according to the present invention.

Referring now to FIG. 1, there is shown a glow plug with combustion pressure sensor 100 of one embodiment according to the present invention. The glow plug with combustion pressure sensor 100 is mounted on an engine head 1 of an internal combustion engine such as a diesel engine of a motor vehicle. The glow plug 100 is arranged to increase a temperature of a combustion chamber 2 during an ignition and startup of the internal combustion engine while detecting a combustion pressure of the combustion chamber 2 for generating an output signal representing a combustion state during the ignition and startup of the engine. This output signal is fed back to an electronic control unit (not shown) for engine control to be performed. Hereunder, a fundamental structure of the glow plug with combustion pressure sensor 100 is described below in detail.

In the following description, for the sake of convenience of illustration, the term "distal end portion" refers to a lower portion of the structure shown in FIG. 1 and the term "base end portion" refers to an upper portion of the structure shown in FIG. 1.

(Fundamental Structure)

The glow plug with combustion pressure sensor 100 includes a housing 10, made of metallic material such as stainless steel or the like, which has an outer profile formed in a nearly stepped cylindrical shape composed of a small diameter portion 10*a* formed at the distal end portion and a large diameter portion 10*b* formed at the base end portion. The housing 10 is mounted on the engine head 1 such that the small diameter portion 10*a* is disposed in a plughole 1*b* formed in the engine head 1 and the large diameter portion 10*b* is located in an area outside of the engine head 1. The housing 10 has a threaded mounting portion 10*c*, formed on the small diameter portion 10*a*, which is held in screwing engagement with a female-threaded portion 1*d* formed on the plughole 1*b*. With such an arrangement, the housing 10 is held in a fixed place with the small diameter portion 10*a* having a leading end 10*aa* held in abutting engagement with a tapered restricting shoulder 1*a* formed in the engine head 1 at a leading end of the plughole 1*b*. The large diameter portion 10*b* has an upper base end 10*d* to which metallic cover 19 is joined to cover the upper base end 10*d*.

A heating member 11 extends through the housing 10 and has a leading end 11*a*, a base end portion 11*b* and an intermediate portion 11*c*. The leading end portion 11*a* of the heating member 11 is exposed to the combustion chamber 2 to directly receive a combustion pressure. The heating member 11 is a ceramic heater comprised of a ceramic compact body and a resistance heating element buried in the ceramic compact body. The base end portion 11*b* and the intermediate portion 11*c* of the heating member 11 are inserted to and fitted to a cylindrical fixing sleeve 12 by brazing for fixing the heating member 11. Also, the fixing sleeve 12 is made of metallic material such as stainless steel or the like.

The base end portion 11*b* of the heating member 11 is electrically connected to a lead wire 17. The lead wire 17 is comprised of a conductive wire 17*a* and a shielding layer 17*b*, made of insulating material, which is provided on an outer periphery of the conductive wire 17*a*. The lead wire 17 has a leading end portion fixedly connected to a base end portion of the resistance heating element via a conducting member (not shown) for capability of supplying electric power to the heating member 11 via the conductive wire 17*a*. The lead wire 17 has a base end portion, inserted through an insertion bore 119 provided in the cover 19 at a center thereof, which protrudes outward from a base-end end face of the cover 19 for electrical connection to an external power source (not shown).

An annular hermetic sealing member 13 is disposed between the leading end 10*aa* of the housing 10 and the tapered restricting shoulder 1*a* of the engine head 1. The annular hermetic sealing member 13 has an outer circumferential periphery that is fixedly attached to the leading end 10*aa* of the housing 10 by welding all around. The annular hermetic sealing member 13 has an inner peripheral wall 13*a* that is fixedly connected to an outer periphery of the fixing sleeve 12 by welding all around. In addition, the sealing member 13 is made of metallic material having small spring constant. Thus, the outer periphery of the fixing sleeve 12 is fixedly supported on the housing 10 by means of the sealing member 13, which does not prevent the heating member 11 from synchronizing in axial displacement upon direct receipt of a combustion pressure.

That is, when the heating member 11 and the fixing sleeve 12 axially displaced toward a base end of the glow plug 100, the sealing member 13 is also displaced toward the base end of the glow plug 100 in synchronisation with the axial displacements of the heating member 11 and the fixing sleeve 12. Therefore, even with the heating member 11 and the fixing sleeve 12 held on the housing 10, the heating member 11 and the fixing sleeve 12 can be axially displaced toward the base end of the glow plug 100. In addition, the sealing member 13 can prevent gasses from flowing from the combustion chamber 2 into the housing 10 via the leading end thereof.

The fixing sleeve 12 has a base end portion 12*a* having an upper end face welded to and fixedly connected to an end face of a leading end portion 14*a* of a cylindrical transfer sleeve 14. The cylindrical transfer sleeve 14 is made of metallic material such as stainless steel and has the same inner and outer diameters as those of the fixing tube 12. In addition, the fixing sleeve 12 and the cylindrical transfer sleeve 14 refers to cylindrical members in claims, respectively.

The large diameter portion 10*b* of the housing 10 accommodates therein a diaphragm 15. The diaphragm 15 has a cylindrical outer sleeve portion 15*a* located in the outermost position, a cylindrical inner sleeve portion 15*b* axially extending from the cylindrical outer sleeve portion 15*a* at a central portion thereof, and a flange-like bridging portion 15*c* through which the diaphragm 15 and the cylindrical inner sleeve portion 15*b* are integrally connected to each other. The cylindrical outer sleeve portion 15*a* has an outer circumferential periphery held in abutting contact with an inner circumferential periphery of the large diameter portion 10*b* of the housing 10 to be fixedly retained therein. The cylindrical inner sleeve portion 15*b* has a leading end fixedly connected to an end face of a base end 14*b* of the transfer sleeve 14 by welding or the like. Further, with the diaphragm 15, the bridging portion 15*c* has a smaller thickness than those of the cylindrical outer sleeve portion 15*a* and the cylindrical inner sleeve portion 15*b*. Here, like the fixing sleeve 12 and the transfer sleeve 14, the diaphragm 15 is made of metallic material such as stainless steel or the like.

Hereunder, the structure of the present embodiment will be described below in detail with a focus on how the combustion pressure, occurring due to explosion in the combustion chamber 2, is transferred and a principle of detecting the combustion pressure.

When the combustion pressure occurs in the combustion chamber 2, the heating element 11 and the fixing sleeve 12 are axially displaced, with accompanying displacement of the transfer sleeve 14 bonded to the fixing sleeve 12 toward the base end portion of the glow plug 100 in an axial direction thereof (as indicated by an arrow A in FIG. 1).

Since the diaphragm 15 is substantially fixed to the engine head 1 by means of the housing 10, the displacement of the transfer sleeve 14 is transferred to the diaphragm 15. In this moment, the cylindrical inner sleeve portion 15*b* is displaced toward the base end of the glow plug 100 with respect to the cylindrical outer sleeve portion 15*a*. This causes the bridging portion 15*c* to bear strain.

The bridging portion 15*c* has an upper end face, facing the base end of the glow plug 100, to which an annular piezoelectric element 16 is coaxially bonded. With the occurrence of strain on the bridging portion 15*c*, the annular piezoelectric element 16 responds to such strain to generate electrical charges in varying rate depending on a piezoelectric characteristic of the piezoelectric element 16 per se. The resulting electrical charges of the piezoelectric element 16 are converted to a voltage signal, which is amplified to provide amplified voltage signal to be output to an on-vehicle ECU (not shown). Thus, the combustion pressure is fed back to perform a combustion control. Here, the piezoelectric element 16 corresponds to a combustion pressure sensor defined in the claims. In addition, the piezoelectric element 16 is comprised of a strain-detecting element such as a piezoelectric or quartz crystal oscillator or the like.

With the present embodiment, further, the glow plug 100 may take the form of a structure employing a stain gauge in place of the piezoelectric element 16 to allow the stain gauge to provide a strain characteristic based on which a combustion pressure is detected. In addition, the piezoelectric element 16 may include, for instance, a plurality of piezoelectric segments in place of the piezoelectric element 16 provided that the piezoelectric segments can detect the existence of average strain on the disc-like bridging portion 15*c* in an unbiased fashion. The piezoelectric segments are placed on the upper wall of the bridging portion 15*c* at circumferentially and equidistantly spaced positions.

In the foregoing, the fundamental structure of the glow plug with combustion pressure sensor 100 has been described. The glow plug with combustion pressure sensor 100 has characteristic structures as will be described below.

(First Characteristic Structure)

As shown in FIG. 1, the cover 19 is associated with the housing 10 to provide a closed inner space B that hermetically accommodate therein the piezoelectric element 16 and the diaphragm 15. With the present embodiment, the cover 19 is comprised of, for instance, a hermetic seal whose large portion is made of metallic material with a partial area having an insulating layer.

The cover 19 has the insertion bore 119 formed in a metallic layer 119*a* made of metallic material such as stainless steel or the like. The metallic layer 119*a* has an outer circumferential periphery fitted to an insulating layer 119*b*, which is placed radially inward of an annular metallic layer 119*c* made of metallic material such as stainless steel or the like. The shielding layer 17*b* is peeled off at a base end portion of the lead wire 17 to expose the conductive wire 17*a*. The conductive wire 17*a* has an outer circumferential periphery to which terminal portions 17*c*, made of metallic material such as stainless steel or the like, are fixed secured in axially spaced relationship by caulking or the like. The conductive wire 17*a* has an intermediate portion 17*d*, corresponding to the base end portion of the lead wire 17 and intervening between the terminal portions 17*c*, which has an outer circumferential wall bonded to the metallic layer 119*a* by welding all around. The intermediate portion 17*d* may be welded to a wall of the insertion bore 119 of the metallic layer 119*a* by arc welding or resistance welding, etc.

With such a structure set forth above, the welded portion formed around the insertion bore 119 prevents ambient air surrounding around the cover 19 from intruding the closed interspace in which the piezoelectric element 16 is accommodated. In addition, the presence of the insulating layer 119*b* avoids the conductive wire 17*a* of the lead wire 17 from being short-circuited to the housing 10 via the cover 19.

With the cover 19 set forth above, no probability takes place for the piezoelectric element 16 to be brought into contact with moisture contained in atmospheric air to prevent the occurrence of a pyroelectric effect. The piezoelectric element 16 can detect the combustion pressure based on strain of the diaphragm 15 with high precision.

Further, the cover 19 is not limited to the hermetic seal. Also, no shape of the cover 19 is limited provided that the cover 19 has the insertion bore 19 and the insulating layer 119*b* to obtain the same effects as those mentioned above. For instance, the cover 19 may be integrally formed with the housing 10 with a partial area formed with the insulating layer 119*b* to hermetically accommodate the piezoelectric element 16.

(Second Characteristic Structure)

The lead wire 17 needs to have flexibility available to absorb the displacement of the heating member 11 due to fluctuation in combustion pressure. To this end, with the present embodiment, the lead wire 17 is comprised of the conductive wire 17*a*, made of copper alloy, which is covered with the shielding layer 17*b* made of fluorine resin.

As set forth above, the lead wire 17 is fixedly attached to the heating member 11 and the cover 19. Therefore, with an axial displacement of the heating member 11 due to fluctuation of the combustion chamber, an intermediate portion 17*e* of the lead wire 17, extending in an area between the end face of the base end portion 11*b* of the heating member 11 and an end face of the cover 19, tends to be displaced in the same extent as that in which the heating member 11 is displaced. However, since the lead wire 17 undergoes a deflection by itself to absorb a displacement component of the heating member 11, a joint portion between the lead wire 17 and the cover 19 encounters no drag to block the axial displacement of the heating member 11.

Therefore, the whole of the displacement component of the heating member 11 resulting from the combustion pressure occurred in the combustion chamber 2 is present in the form of the diaphragm 15 via the fixing sleeve 12 and the transfer sleeve 14. That is, the diaphragm 15 undergoes strain in conformity to the combustion pressure, so that the piezoelectric element 16 generates an output signal with high precision in accord with the combustion pressure.

Further, a formation material of the lead wire 17 has a quality that is not particularly limited provided that the formation material is composed of material with excellent flexibility and heat resistance. In addition, the conductive wire 17*a* of the lead wire 17 may be comprised of a single wire. In another alternative, the conductive wire 17*a* of the lead wire 17 may include a twisted wire composed of a plurality of thin copper wires.

(Third Characteristic Structure)

With the glow plug with combustion pressure sensor 100 mounted to the plughole 1*b*, the lead wire 17 oscillates at a natural frequency with a fixed portion between the heating member 11 and the cover 19 acting as a fixing end upon receipt of an oscillation exerted from the outside. With such an oscillation repeatedly exerted, the conductive wire 17*a* of the lead wire 17 undergoes fatigue with the accompanying possibility of fatigue burnout.

To avoid such a defect, an air space 20 is defined between an outer circumferential wall of the lead wire 17 and an inner circumferential wall of the transfer sleeve 14. The air space 20 accommodates therein three cylindrical antivibration members 18, each composed of resilient material such as fluorine rubber or the like, which are coaxially placed inside the air space 20 at axially spaced positions. With the present embodiment, particularly, the antivibration members 18 have outer circumferential peripheries fixedly held in contact with the inner circumferential wall of the transfer sleeve 14 and inner circumferential peripheries radially spaced from the outer circumferential wall of the lead wire 17 by open space portions 20*a*. This does not block the flexing of the lead wire 17. In addition, the inner circumferential peripheries of the antivibration members 18 may be fixed to the outer circumferential wall of the lead wire 17 so as to provide the open space portions between the outer circumferential wall of the antivibration members 18 and the inner circumferential wall of the transfer sleeve 14.

With such a structure, when the lead wire 17 flexes, the lead wire 17 is brought into contact with one or more of the antivibration members 18 to damp the natural frequency of the lead wire 17, thereby avoiding the disconnection of the conductive wire 17*a*. Further, the antivibration members 18 prevents the outer circumferential wall of the lead wire 17 from being brought into contact with the inner circumferential wall of the transfer sleeve 14 when subjected to the natural frequency of the wire lead 17. This prevents noise, occurring due to a contact between the outer circumferential wall of the lead wire 17 and the inner circumferential wall of the transfer sleeve 14, from being superimposed on the output signal generated by the piezoelectric element 16. This further prevents not only the occurrence of a drop in SN ratio but also the occurrence of the natural frequency of the lead wire 17 being transferred to the transfer sleeve 14.

Further, the antivibration members 18 may be preferably placed in areas corresponding to peak portions of vibration amplitudes during oscillation of the lead wire 17 at the natural frequency. Furthermore, the open space 20 is preferably determined to have an adequate radial space, i.e. for instance 0.1 mm or more such that when the lead wire 17 is caused to flex with most displacement in a radial direction, no outer circumferential wall of the lead wire 17 is brought into contact with the inner circumferential wall of the transfer sleeve 14.

Another Embodiment

While the present invention has been described above with reference to various embodiments in which the heating element 11 is comprised of the ceramic heater, it will be appreciated that it may suffice to use a heater formed in a metallic cylinder body accommodating therein a heating coil.

Figure 2:
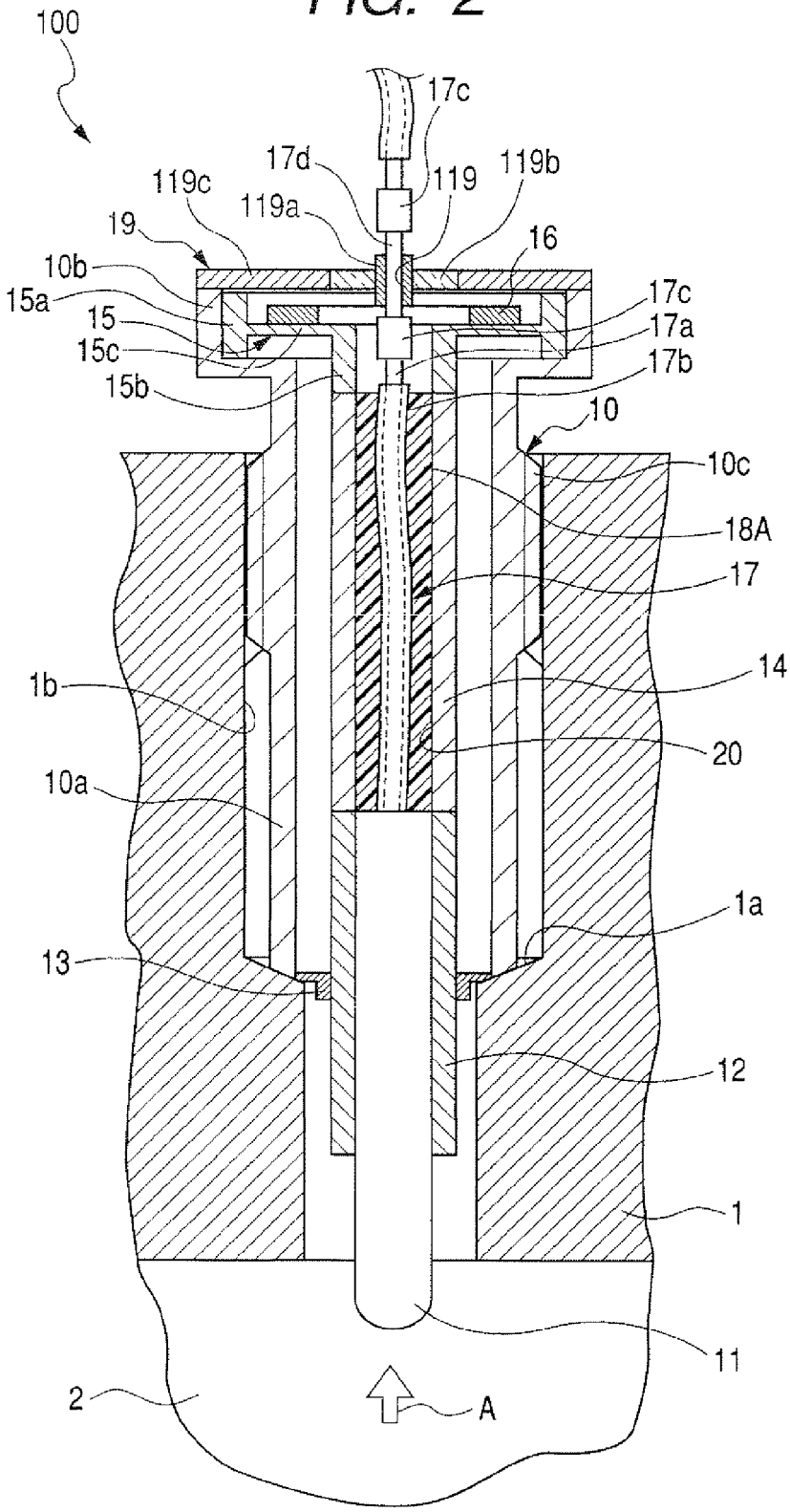
FIG. 2 is a cross sectional view showing an essential part of a glow plug with combustion pressure sensor of another embodiment according to the present invention.
Figure 3:
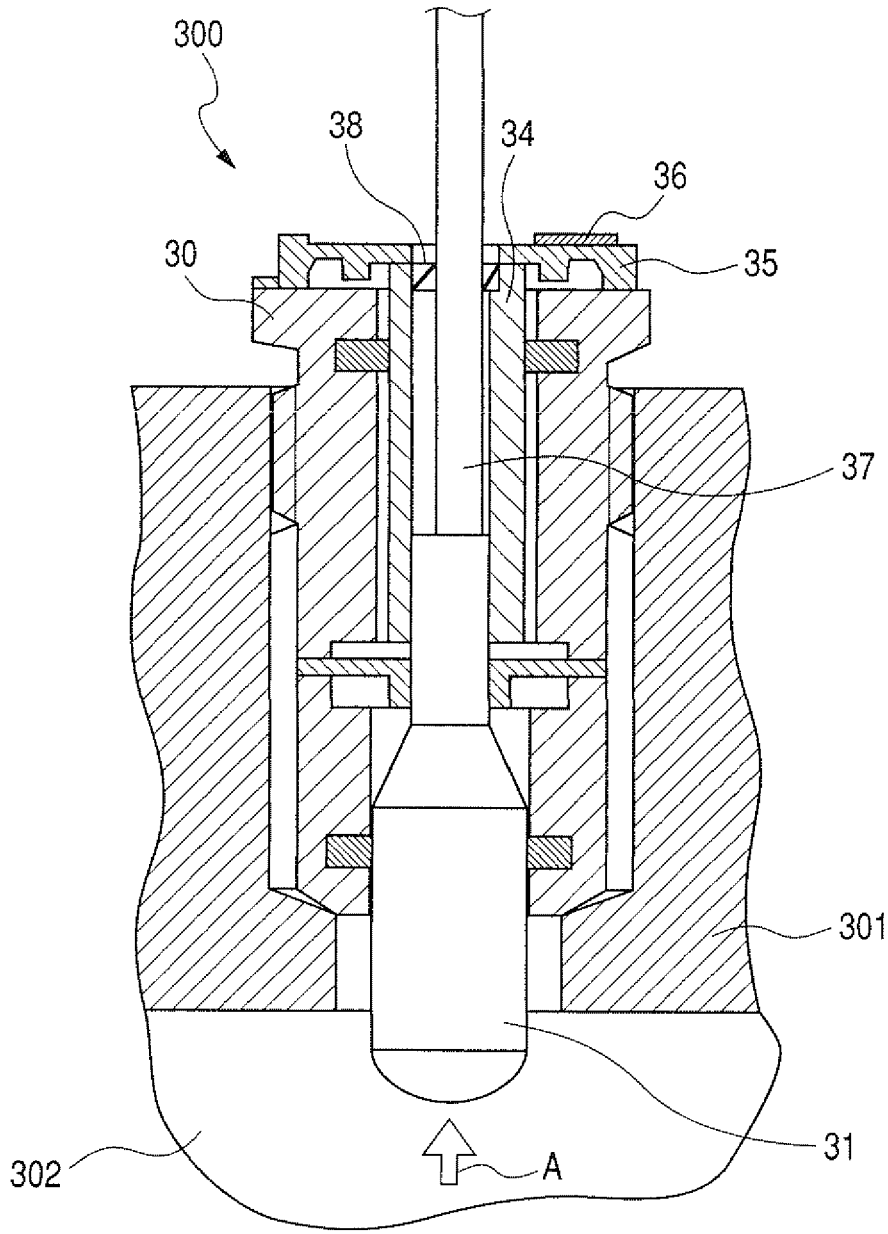
FIG. 3 (PRIOR ART)
FIG. 3 is a cross sectional view showing an essential part of a glow plug with combustion pressure sensor of the related art.

With the present embodiment, although the antivibration members 18 have been described above as having cylindrical structures in shape, the antivibration members 18 may take annular shapes. In addition, the number of the antivibration members 18 to be provided is not limited. Further, the antivibration members 18 may be replaced by an antivibration material 18A filled in the open space 20 between the outer circumferential wall of the lead wire 17 and the inner circumferential wall of the transfer sleeve 14 as shown in FIG. 2. In particular, the antivibration material 18A is comprised of a liquid sealant such as a potting material, composed of silicone rubber, or the like, providing the same advantageous effects as those of the antivibration members 18. The liquid sealant has adequately small Young's modulus with no occurrence of an effect of blocking the flexure of the lead wire 17. Furthermore, no antivibration member may be disposed provided that the outer circumferential wall of the lead wire 17 is radially spaced from the inner circumferential wall of the transfer sleeve 14 by a distance of, for instance, 0.1 mm or more.

With the present embodiment, further, the lead wire 17 is radially spaced from the inner circumferential wall of the transfer sleeve 14 by the open space portions 20*a*. However, there may be no open space portions 20*a*. That is, the antivibration members 18 may be arranged in structure to be brought into contact with both the lead wire 17 and the transfer sleeve 14 provided that each of the antivibration members 18 has small Young's modulus with no hindrance to the flexure of the lead wire 17.

While the specific embodiments of the present invention have been described in detail, the present invention is not limited to the particularly illustrated structures of the glow plug of the various embodiment set forth above. It will be appreciated by those skilled in the art that various other modifications and alternatives to those details could be developed in light of the overall teachings of the disclosure.

What is claimed is:

1. A glow plug with combustion pressure sensor comprising:

a heating member adapted to be placed in one end of a plughole to raise a temperature of a combustion chamber;

a cylindrical member fixedly secured to an outer circumferential wall of the heating member;

a housing adapted to be fixedly secured to the plughole and holding an outer circumferential wall of the cylindrical member for an axial displacement capability;

a diaphragm fixedly supported with the housing and the cylindrical member;

a combustion pressure sensor mounted on the diaphragm and responsive to strain occurring in the diaphragm due to axial displacement of the cylindrical member for detecting a combustion pressure of the combustion chamber;

a cover associated with the housing to define a closed air space to hermetically accommodate the combustion pressure sensor and having an insertion bore; and a lead wire fixedly connected to the cover and fixedly connected to the heating member to supply electric power thereto, the lead wire extends through the insertion bore and is hermetically bonded to an inner circumferential wall of the insertion bore, wherein a portion of the lead wire disposed within the cylindrical member has flexibility, whereby the lead wire can deflect within the cylindrical member to absorb an axial displacement of the heating member.

2. The glow plug with combustion pressure sensor according to claim 1, wherein:

the lead wire includes a conductive wire and a shielding layer, made of insulating material and covered on an outer circumferential periphery of the conductive wire, which has flexibility.

3. The glow plug with combustion pressure sensor according to claim 1, wherein:

the combustion pressure sensor includes one of a piezoelectric element and a strain gauge.

4. The glow plug with combustion pressure sensor according to claim 1, wherein:

a clearance is provided between an outer circumferential wall of the lead wire and an inner circumferential wall of the cylindrical member.

5. The glow plug with combustion pressure sensor according to claim 4, wherein:

the clearance is spaced in an extent not to cause the outer circumferential wall of the lead wire and the inner circumferential wall of the cylindrical member to be brought into contact with each other when the lead wire flexes greatest due to an axial displacement of the heating member caused by fluctuation in combustion pressure.

6. The glow plug with combustion pressure sensor according to claim 1, further comprising:

an antivibration member disposed in the clearance between the outer circumferential wall of the lead wire and the inner circumferential wall of the cylindrical member.

7. The glow plug with combustion pressure sensor according to claim 1, wherein:

the antivibration member is made of resilient material.

8. The glow plug with combustion pressure sensor according to claim 1, wherein:

the heating member includes a ceramic heater.

9. The glow plug with combustion pressure sensor according to claim 1, wherein:

the lead wire is fixedly connected directly to the heating member.

* * * * *